United States Patent [19]

Bird

[11] Patent Number: 4,895,070

[45] Date of Patent: Jan. 23, 1990

[54] LIQUID TRANSFER ASSEMBLY AND METHOD

[75] Inventor: John W. Bird, Westport, Conn.

[73] Assignee: Birow, Incorporated, Westport, Conn.

[21] Appl. No.: 217,412

[22] Filed: Jul. 11, 1988

[51] Int. Cl.[4] ..... B41L 23/00

[52] U.S. Cl. ..... 101/148; 101/216; 101/349; 101/367; 118/46

[58] Field of Search ..... 101/348, 349, 147, 148, 101/350, 152, 153, 174, 216, 367; 118/46

[56] References Cited

U.S. PATENT DOCUMENTS

| | | | |
|---|---|---|---|
| 3,259,062 | 7/1966 | Dahlgren | 101/148 |
| 3,411,442 | 11/1968 | Muhlich | 101/148 |
| 3,786,746 | 1/1974 | Roberts | 101/350 |
| 4,610,201 | 9/1986 | Jeschke | 101/DIG. 28 |

FOREIGN PATENT DOCUMENTS

| | | | |
|---|---|---|---|
| 8501971 | 4/1986 | PCT Int'l Appl. | 101/147 |

*Primary Examiner*—Eugene H. Eickholt
*Attorney, Agent, or Firm*—Perman & Green

[57] ABSTRACT

A liquid transfer assembly is shown which transfers a predetermined thickness of liquid to a moving surface, the assembly employing a shearing action to achieve the predetermined thickness. The system includes a supply means for providing a source of the liquid; a first arcuately shaped surface which moves at a first speed and is adapted to contact the supply means so as to obtain a coating of liquid on its surface. A second surface is juxtaposed to the first surface but not in contact therewith, moves at a second speed different from the first speed; and the distance between the two surfaces is sufficiently close that the liquid on the first surface comes in contact with the second surface at their nearest point of proximity. Thus, by virtue of the different surface velocities, the liquid is subjected to a shearing action at the nearest point of proximity with a determined amount thereof being transferred to the second surface.

4 Claims, 1 Drawing Sheet

LIQUID TRANSFER ASSEMBLY AND METHOD

FIELD OF THE INVENTION

This invention relates to offset lithographic printing and more particularly to a means and method for transferring liquid from a reservoir to an offset lithographic plate cylinder.

BACKGROUND OF THE INVENTION

In offset lithographic printing, each printing stage includes a plate cylinder, to which printing plates are tightly fastened around its circumference. The plate cylinder is equipped with inking and dampening mechanisms. The plate includes both image and non-image areas which are substantially coplanar, the image portions being hydrophobic and the non-image areas being hydrophilic. The dampening system applies an aqueous solution to the non-image areas and the inking system applies a greasy ink to the image areas. The plate cylinder transfers its image to an intermediate blanket cylinder which has a specially composed smooth rubber blanket surface. Printing stock in either sheet or webbed form is fed against the blanket cylinder by an impression cylinder and the ink (and dampening solution), is transferred to the printing stock thus completing the printing operation.

In applicator roll assemblies used with conventional lithographic printing cylinders, a pick-up roll is partially immersed in a trough containing a continuous supply of liquid. The liquid may be water, ink or a coating composition. The surface of the pick-up roll "picks up" a relatively thick coating of the liquid and rotates it into contact with a metering roll which controls or meters the thickness of the coating which is to remain on the surface of the pick-up roll. Excess liquid is returned to the trough. Further rotation of the pick-up roll brings it into pressure contact with an applicator roll whereby the applicator roll obtains a coating of the liquid from the pick-up roll. Finally, the applicator roll rotates into pressure contact with the plate cylinder (or in some instances the blanket cylinder) which is coated with the liquid by the pressure/rolling action of the applicator roll.

As the applicator roll moves about the outer periphery of the plate cylinder, it comes into contact with a plate clamp aperture where plates are secured to the outer periphery of the plate cylinder. Unless the applicator roll/plate cylinder contact pressure is very closely controlled, the clamp aperture will often cause the applicator role to slightly move away from the periphery of the plate cylinder as the plate clamp aperture passes beneath it. This can create an interruption in the application of the liquid to the plate with resulting nonuniformities in the printed product.

Accordingly, it is an object of this invention to provide an improved liquid transfer assembly for offset lithographic printing apparatus.

It is another object of this invention to provide an improved liquid transfer assembly for offset lithographic printing apparatus wherein uniform layers of applied liquid result from the action of the transfer assembly.

SUMMARY OF THE INVENTION

A liquid transfer assembly is shown which transfers a predetermined thickness of liquid to a moving surface, the assembly employing a shearing action to achieve the predetermined thickness. The system includes a supply means for providing a source of the liquid; a first arcuately shaped surface which moves at a first speed and is adapted to contact the supply means so as to obtain a coating of liquid on its surface. A second surface is juxtaposed to the first surface but not in contact therewith; moves at a second speed different from the first speed; and the distance between the two surfaces is sufficiently close that the liquid on the first surface comes in contact with the second surface at their nearest point of proximity. Thus, by virtue of the different surface velocities, the liquid is subjected to a shearing action at the point of proximity with a determined amount thereof being transferred to the second surface.

DETAILED DESCRIPTION OF THE INVENTION

Reference is made to the following copending applications, all of which describe further details of an offset lithographic printing apparatus useful in conjunction with the invention hereof. The disclosure of each is incorporated herein expressly by reference: U.S. patent application, Ser. No. 65,914 filed June 24, 1987 and entitled "Coating and Printing Method and Apparatus Including An Interstation Dryer"; and U.S. Pat. No. 4,796,556 entitled "Adjustable Coating and Print Apparatus"; all to John W. Bird.

Figure 1:
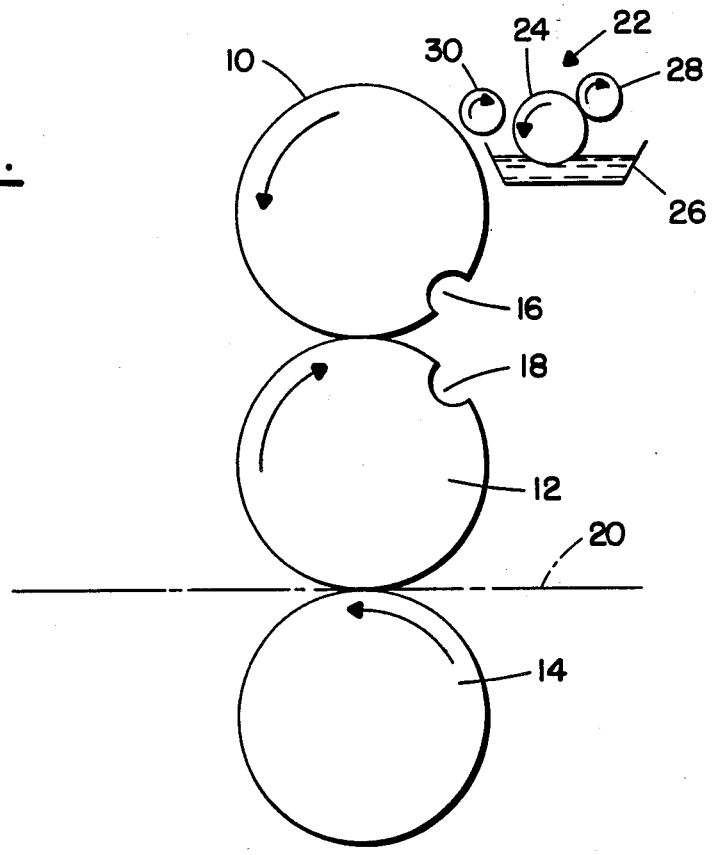
FIG. 1 is a side, schematic view of an offset lithographic printing apparatus showing the relationship of the liquid transfer assembly thereto.

Referring now to FIG. 1, plate cylinder 10, blanket cylinder 12 and impression cylinder 14 are all of the conventional variety normally found in offset lithographic printing machines. Plate cylinder 10 is provided with a plate clamp aperture 16 wherein the print plate (not shown) is clamped to the external circumference of plate cylinder 10. In a similar manner, blanket cylinder 12 is provided with a blanket clamp aperture 18 where the blanket is secured. As is well known, a continuous conveyer belt, schematically shown at 20, feeds sheets to be imprinted between blanket cylinder 12 and impression cylinder 14.

A dampening system 22 includes a pick-up roll 24 which has a part of its circumference immersed in liquid bath 26 (e.g. water). A metering roll 28 is positioned to co-act with pick-up roll 24 to remove excess and otherwise assure a continuous film of liquid on pick-up roll 24. An applicator roll 30 is positioned so as to be close to, but not in contact with pick-up roll 24 as well as the outer surface of plate cylinder 10. In this preferred embodiment, pick-up roll 24, metering roll 28 and applicator roll 30 are each individually driven by separate motors so as to enable the speed of each to be individually adjusted. While not shown, additional coating stations for the purpose of applying inking solutions or coating solutions may also be emplaced about the periphery of plate cylinder 10 in the normal manner. It is here emphasized that the liquid transfer principle to be hereinafter discussed with respect to the dampening system, applies, in substance, to other coating application stations.

Figure 2:
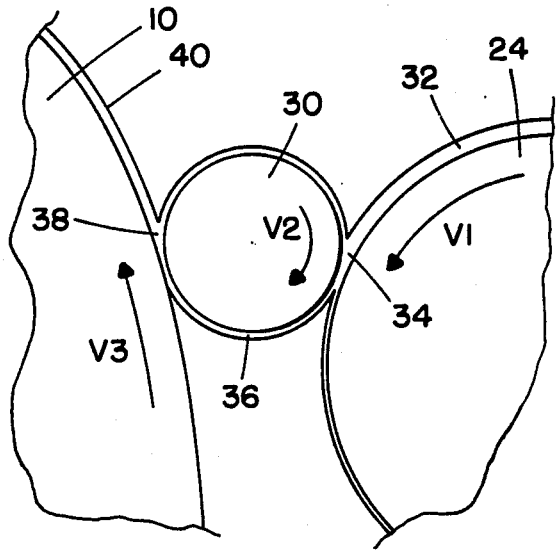
FIG. 2 is an expanded view of the contact surfaces of liquid transfer assembly.

Referring now to FIG. 2 in conjunction with FIG. 1, an expanded view of applicator roll 30 is shown in conjunction with portions of plate cylinder 10 and pick-up roll 24. After the surface of pick-up roll 24 leaves the vicinity of metering roll 28, a layer of liquid 32 (e.g. water) resides on its surface. The peripheral velocity of pick-up roll 24 is adjusted so that it exhibits a characteristically constant velocity V1. The distance between the surfaces of applicator role 30 and pick-up roll 24, at their nearest point of proximity 34, is adjusted so that the surface of applicator role 30 comes into contact with liquid layer 32 as it passes therebetween. Velocity V2 of applicator role 30 is adjusted to be greater than V1 so as to create, at proximity point 34, a shearing action on liquid 32. This shearing action causes a layer of liquid 36 to adhere to the outer periphery of applicator role 30 and to be carried around its periphery until it comes into contact at proximity point 38 with the external periphery of plate cylinder 10. Here again, the velocity V3 of plate cylinder 10 is adjusted to be higher than V2 so that a further shearing action occurs on liquid layer 36 as it reaches point 38. The shearing action results in a layer of liquid 40 being applied to plate cylinder 10.

By adjusting the relative velocities of the rolls/cylinder surfaces, the thicknesses of liquid layers 36 and 38 can be readily adjusted (assuming identical wetting characteristics of the moving surfaces). More specifically, as the velocity V2 is increased with respect to V1, a thicker layer of liquid 36 adheres to the surface of applicator role 30. In similar fashion, as the velocity V3 of plate cylinder 10 is increased with respect the velocity V2 of applicator roll 30, the thickness of liquid layer 40 can be made to increase. Conversely, as peripheral velocities V2 and V3 approach each other, the layer 40 of liquid adhering to plate cylinder 10 will decrease in thickness. However, if the peripheral velocities become equal or so close as to negate a shearing action, the liquid layer thicknesses will split and tend to become non-uniform.

The above stated, non-contacting liquid application system provides a number of advantages. One is that there is no contact between applicator role 30 and plate cylinder 10 thereby preventing any contact between applicator role 30 and plate clamp aperture 16. Another is that the amount of wear on the respective rolls/cylinder is greatly decreased. The system further provides for relatively easy adjustment of the amounts of liquid to be applied to plate cylinder 10. As aforestated, it is important that the peripheral velocities of adjoining rolls/cylinder be somewhat different to sustain the shearing action which creates the desired thickness of liquid coating.

The motive power for each of the rolls and cylinders should be linearly adjustable in speed so as to provide the desired variability of circumferential velocities. Hydraulic motors are preferred; however electric motors of the variable speed variety are also acceptable.

The above described liquid transfer assembly is particularly adapted to application as a dampening system for a plate cylinder. This is due to the fact that the viscosity of water is relatively constant (notwithstanding temperature changes) and enables the dampening system, once adjusted, to operate properly for long periods of time. On the other hand, if the viscosity of the liquid is subject to large changes or is highly viscous, this invention is less well suited. It is applicable to inking systems where ink of relatively medium to low viscosities are employed and to coating applications where relatively constant viscosity coating materials are utilized.

This invention further reduces the maintenance necessary for offset printing apparatus and substantially negates the need for chilling of the dampening solution. As is well known, especially for web presses, roll pressures generate substantial heat and cause the dampening solution to increase in temperature—thereby requiring refrigeration. This invention decreases the resulting roll-generated heat and this reduces refrigeration requirements.

It is to be understood that the above described embodiment of the invention is illustrative only and that modifications throughout may occur to those skilled in the art. Accordingly, this invention is not to be regarded as limited to the embodiment disclosed herein but is to be limited as defined by the appended claims.

I claim:

1. In an assembly for transferring a predetermined thickness of liquid to a moving surface, said liquid exhibiting a relatively constant velocity over the operating conditions experienced by said assembly, the combination comprising:

supply means for producing a source of said liquid:

a liquid bearing applicator roll movable at a first speed and adapted to contact said supply means and obtain a coating of said liquid on said surface;

a plate cylinder juxtaposed to said applicator roll and adapted to be moved at a second speed different from said first speed, said plate cylinder being maintained out of contact with said applicator roll but sufficiently close thereto that said liquid coating on said applicator roll comes in contact with said plate cylinder at the nearest point of proximity of said roll and cylinder, whereby said liquid coating is subjected to a shearing action at said nearest point of proximity with a determined amount thereof being transferred to said plate cylinder by shearing action.

2. The invention as recited in claim 1 wherein said liquid is water.

3. The invention as recited in claim 1 wherein said liquid is ink.

4. The invention as recited in claim 1 wherein said liquid is a coating material.

* * * * *